US007476188B2

(12) United States Patent
Perez, Jr.

(10) Patent No.: US 7,476,188 B2
(45) Date of Patent: Jan. 13, 2009

(54) TORSO EXERCISE DEVICE

(75) Inventor: Charles B. Perez, Jr., Venice, CA (US)

(73) Assignee: Integrity Partners, Inc., Los Angeles, CA (US)

( * ) Notice: Subject to any disclaimer, the term of this patent is extended or adjusted under 35 U.S.C. 154(b) by 63 days.

(21) Appl. No.: 11/422,840

(22) Filed: Jun. 7, 2006

(65) Prior Publication Data

US 2006/0281610 A1 Dec. 14, 2006

Related U.S. Application Data

(60) Provisional application No. 60/595,195, filed on Jun. 14, 2005.

(51) Int. Cl.
*A63B 26/00* (2006.01)

(52) U.S. Cl. ..... 482/142; 472/103; 482/140

(58) Field of Classification Search ..... 482/142, 482/140, 35, 123, 130, 907; 472/95, 103–105; D21/676, 686, 690, 662
See application file for complete search history.

(56) References Cited

U.S. PATENT DOCUMENTS

| | | | | |
|---|---|---|---|---|
| 2,494,094 | A | 1/1950 | Horstman | |
| 2,707,465 | A | 5/1955 | Nemeth | |
| D198,923 | S | 8/1964 | Mitchell et al. | |
| 4,830,345 | A | 5/1989 | Mar | |
| 4,860,733 | A | 8/1989 | Parker, Jr. | |
| 5,052,684 | A | 10/1991 | Kosuge et al. | |
| D337,216 | S | 7/1993 | Boyd | |
| 5,421,800 | A | 6/1995 | Mullen | |
| 5,810,751 | A | 9/1998 | Meier et al. | |
| 6,022,303 | A | 2/2000 | Abdo | |
| 6,152,866 | A * | 11/2000 | Kuo | 482/142 |
| 6,248,047 | B1 | 6/2001 | Abdo | |
| 6,428,450 | B1 | 8/2002 | Ho et al. | |
| 6,468,191 | B1 | 10/2002 | Cameron | |
| 6,491,611 | B1 | 12/2002 | Stearns | |
| 6,575,884 | B1 | 6/2003 | Eazor | |
| 6,602,171 | B1 | 8/2003 | Tsen et al. | |
| 6,666,802 | B1 | 12/2003 | Rasmussen | |
| 6,712,743 | B2 | 3/2004 | Chen | |
| 6,716,144 | B1 | 4/2004 | Shifferaw | |
| D499,457 | S | 12/2004 | Kuo | |
| 7,134,989 | B2 * | 11/2006 | Liao | 482/142 |
| 2002/0173412 | A1 * | 11/2002 | Stearns | 482/123 |
| 2003/0060347 | A1 | 3/2003 | Tang | |
| 2005/0101460 | A1 * | 5/2005 | Lobban | 482/140 |
| 2005/0143233 | A1 | 6/2005 | Shifferaw | |
| 2006/0116261 | A1 * | 6/2006 | Hsiung et al. | 482/140 |

* cited by examiner

*Primary Examiner*—Lori Amerson
(74) *Attorney, Agent, or Firm*—Kelly Lowry & Kelley, LLP

(57) ABSTRACT

A torso exercise device includes a base support frame, a seat assembly, and a back support assembly. The seat assembly includes a seat and mechanism for connecting the seat to the base support frame in a manner enabling multi-directional resistive movement of the seat relative to the base support frame. The back support assembly is pivotally connected to the base support frame.

20 Claims, 5 Drawing Sheets

TORSO EXERCISE DEVICE

BACKGROUND OF THE INVENTION

The present invention generally relates to torso exercise devices. More particularly, the present invention relates to a torso exercise device comprising an oscillating seat mounted on a resilient spring permitting a user to move his or her torso in any radial direction thereby exercising the muscles of the torso.

Exercise is an important part of a healthy lifestyle. A wide variety of exercise devices exist that provide cardiovascular exercise or resistance exercise to various muscle groups of a person's body. The look of a well-defined torso is highly prized, especially among men who desire to have well-defined chest and stomach muscles. In view of this, it comes as no surprise that included among the aforementioned exercise devices are a variety of torso exercise devices.

A desirable feature of a torso exercise device provides for more than a single type of movement (e.g., lateral, longitudinal, pivotal, etc.) of the exerciser's body in order to mimic a wide variety of torso exercises. Another desirable feature of such an exercise device is the ability to be adjusted to meet the physical characteristics of a wide variety of exercisers who vary from person-to-person in terms of body type, height, etc.

Torso exercise devices have been used in professional gyms or fitness centers for many years. However, torso exercise devices designed for use in professional gyms or fitness centers have certain disadvantages when those torso exercise devices are used outside the setting of a professional gym or fitness center as these torso exercise devices can be large, cumbersome, limited in their versatility and are often difficult to operate, transport, and store. Such devices are also relatively expensive. While such devices are generally adequate in the fitness center or gym setting due to the large space available in such settings, such devices do not lend themselves to a household setting. For home use, the exercise device must not only be effective, but also compact and/or collapsible in order to easily transport and store the exercise device. The exercise device must also be relatively simple in operation and inexpensive.

Devices for torso exercises are generally known in the art. For example, one such device is disclosed in U.S. Pat. No. 6,716,144 which discloses a seat member to a pivotally connected back member including an adjustable resilient spring to provide resistance and absorb impact during abdominal exercise. Another such device is disclosed in U.S. Pat. No. 6,575,884 which also discloses a seat member pivotally connected to back member including a resistance means. A further example of a torso exercise device is U.S. Pat. No. 6,602,171 which discloses a seat member rigidly connected to a back member and a handle pivotally connected to a resilient mechanism. Another example is U.S. Pat. No. 6,491,611 which teaches a seat pivotally mounted on a frame and at least one handle bar pivotally mounted on the frame and connected to a resistance device. An additional example of a torso exercise device is U.S. Pat. No. 6,428,450 which discloses an exercise device having a seat member connected to a base frame, a back member pivotally connected to the base frame and two handles pivotally connected to the back cushion and slidably connected to the base frame. A clear drawback to each of these devices is that movement is restricted to one plane, i.e., forward and backward. None of these inventions permit side-to-side movement or movement in any other radial direction.

As outlined above, various attempts have been made to overcome the limitations associated with previous torso exercise devices. However, as pointed out, some of these exercise devices have certain drawbacks. Additionally, these devices are not easily collapsible while others place unnecessary and dangerous strain and stress on the neck and back of the user of the device if the device cannot be adjusted to best suit the physical characteristics of a wide range of users. For example, the same exercise device should be able to be used by a very tall exerciser as well as a very short exerciser so that any size user can obtain optimum results from exercise. Also, for those individuals who travel and do not have access to a gymnasium in order to exercise, it is imperative that the exercise device be portable in nature.

Accordingly, there is a need for a torso exercise device which is suited for home use and enables a user to exercise the muscles of his or her torso in any direction of movement. Such a torso exercise device should be collapsible in order to be easily transported and stored, and also be relatively simple in operation and inexpensive. Preferably, such an exercise device should be adjustable in order to accommodate the size of the user of the device. The present invention fulfills this need and provides other related advantages.

SUMMARY OF THE INVENTION

The present invention resides in a torso exercise device suited for home use, relatively simple to operate and is collapsible in order to be easily transported and stored. A torso exercise device embodying the present invention includes a base support frame, a seat assembly, and a back support assembly. The seat assembly includes a seat and a mechanism for connecting the seat to the base support frame in a manner enabling multi-directional resistive movement of the seat relative to the base support frame. The back support assembly is pivotally connected to the base support frame. In a preferred form, the multi-directional resistive movement comprises pivotal, orbital, swiveling or rotational oscillating movement.

In a preferred embodiment, the seat connecting mechanism comprises a spring coil disposed between the base support frame and the seat.

The torso exercise device includes a leg support assembly extending from the seat assembly. Preferably, the leg support assembly includes a footrest. The torso exercise device also includes a pair of handles fixed relative to the base support frame and extending upwardly therefrom.

The base support frame comprises two ground-engaging sub-frames, wherein the ground-engaging sub-frames are joined by a hinge. The hinge includes a lock for holding the ground-engaging sub-frames in an open position.

The back support assembly includes a back support and a mechanism for providing resistance to pivotal movement of the back support relative to the base support frame. The resistance providing mechanism includes a resistance piston.

Other features and advantages of the present invention will become apparent from the following more detailed description, taken in conjunction with the accompanying drawings, which illustrate, by way of example, the principles of the invention.

BRIEF DESCRIPTION OF THE DRAWINGS

The accompanying drawings illustrate the invention. In such drawings.

DETAILED DESCRIPTION OF THE PREFERRED EMBODIMENTS

Figure 1:
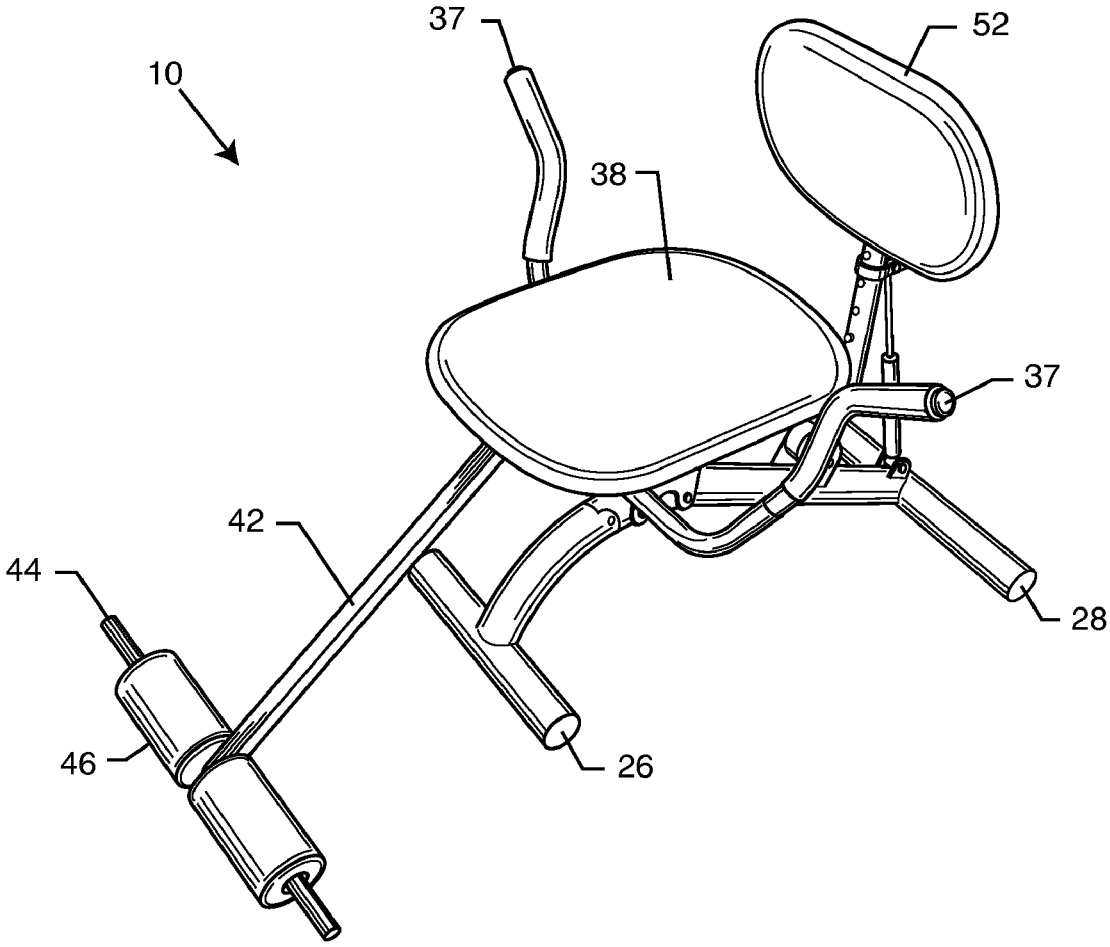
FIG. 1 is an elevated front perspective view of a torso exercise device of the present invention.
Figure 2:
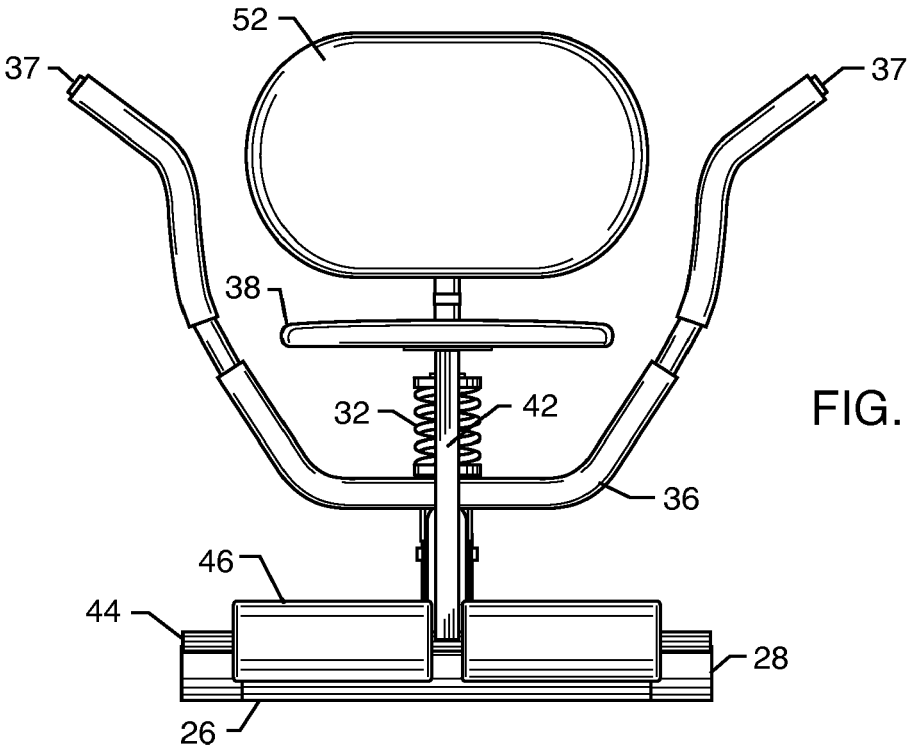
FIG. 2 is a front view of the device of FIG. 1.
Figure 3:
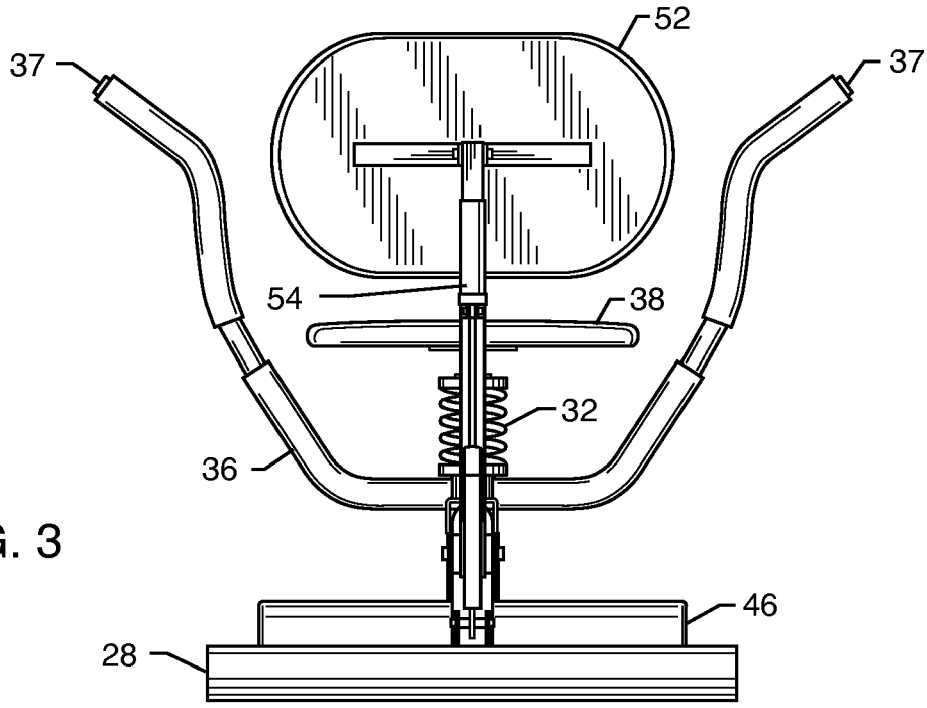
FIG. 3 is a back view of the device of FIG. 1.
Figure 4:
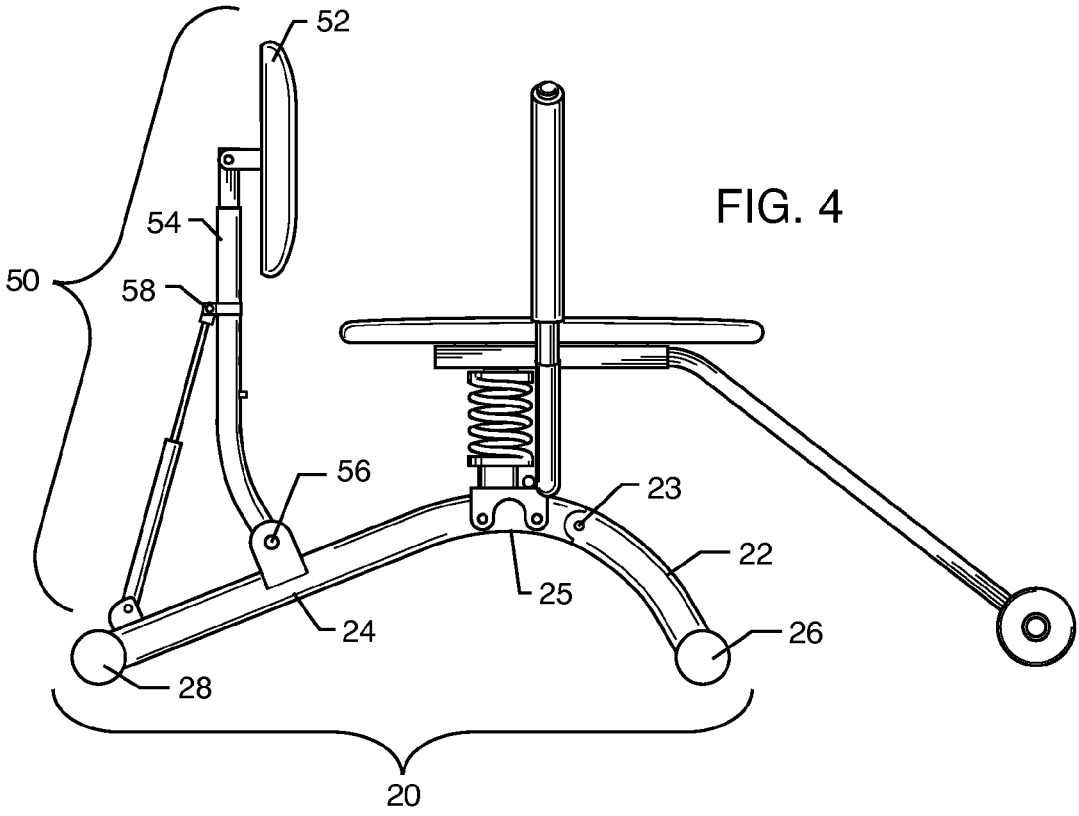
FIG. 4 is a left side view of the device of FIG. 1.
Figure 5:
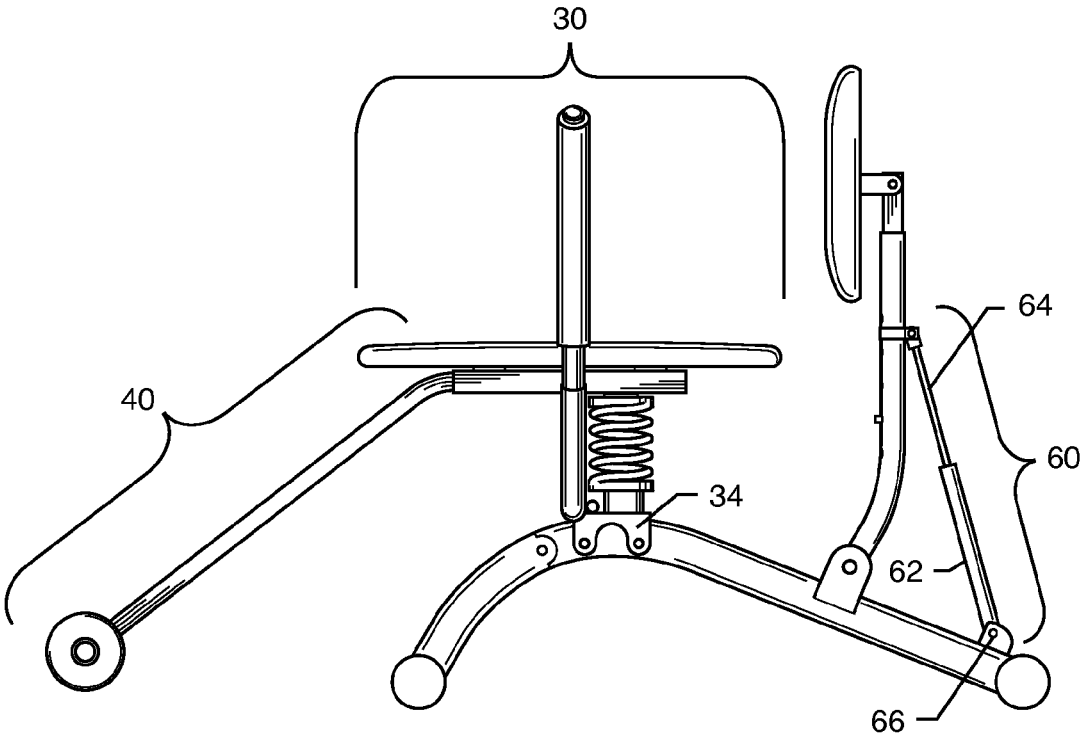
FIG. 5 is a right side view of the device of FIG. 1.
Figure 6:
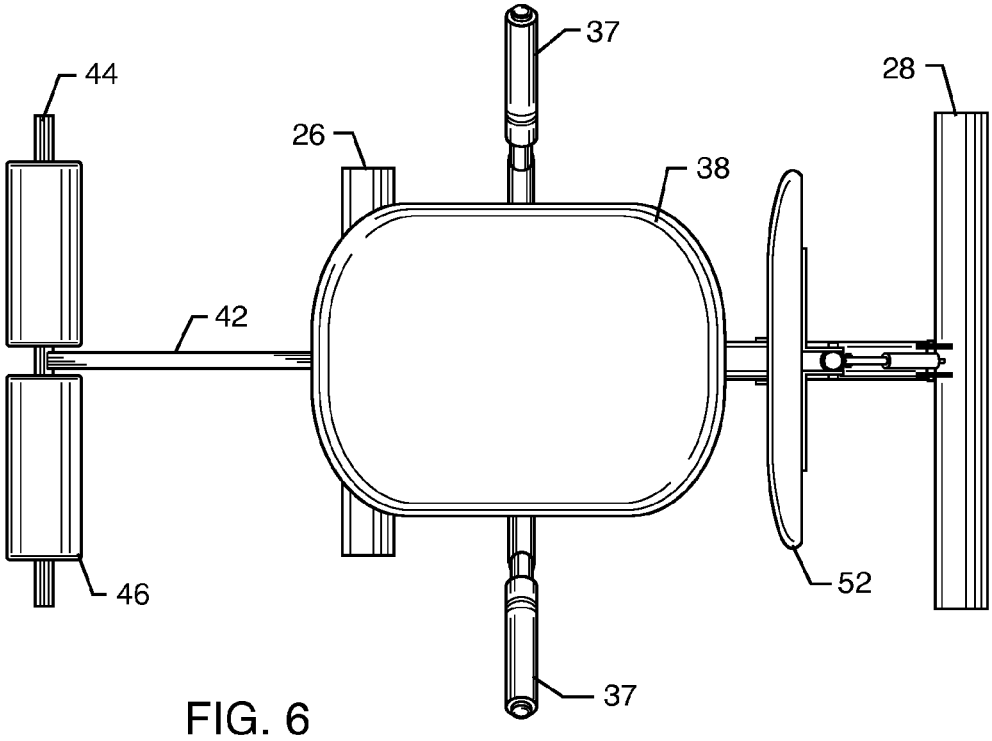
FIG. 6 is a top view of the device of FIG. 1.
Figure 7:
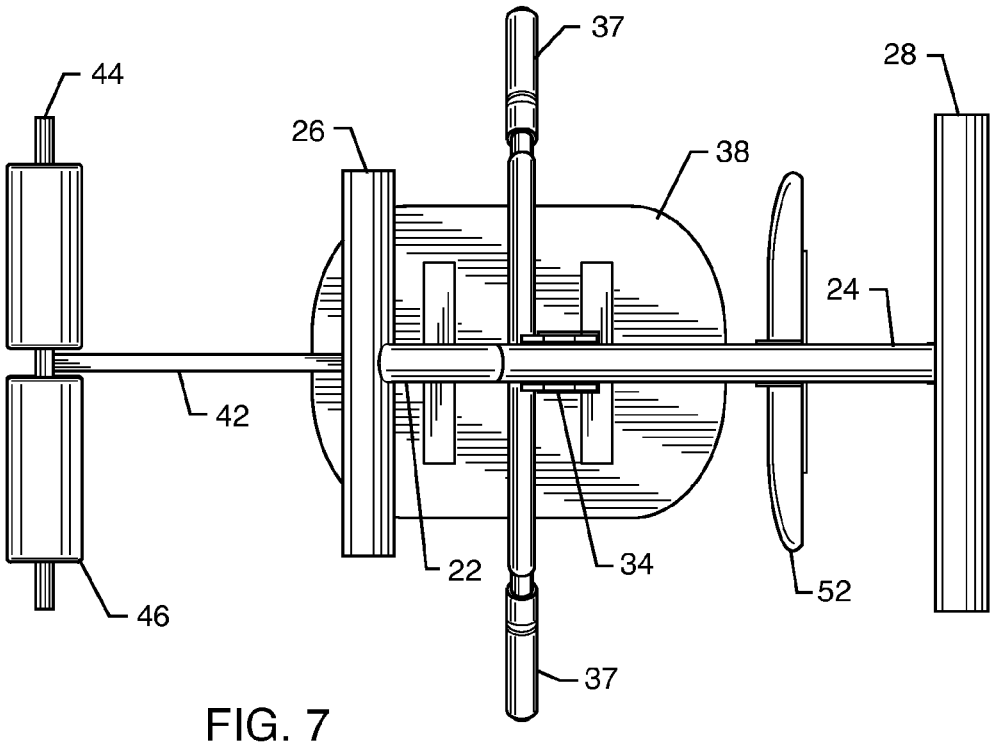
FIG. 7 is a bottom view of the device of FIG. 1.

As shown in the accompanying drawings, for purpose of illustration, the present invention resides in a torso exercise device, generally referred to by the reference numbers 10, 70, that provides an oscillating seat mounted on a resilient spring that permits a user to move his or her torso in any radial direction thereby exercising the muscles of his or her torso. As seen in FIGS. 1-7, the torso exercise device 10 includes a base support frame or base support assembly 20, a seat assembly 30 connected to the base support assembly 20, a leg support assembly 40 fixedly connected to and extending from the seat assembly 30, and a back support assembly 50 pivotably connected to the base support assembly 20.

The base support assembly 20 includes a first ground-engaging sub-frame, in the form of a front leg 22, pivotably connected to a second ground-engaging sub-frame, in the form of a back leg 24, by a pivoting hinge 23. A front foot 26 is connected to the front leg 22 in a perpendicular relationship. Similarly, a back foot 28 is connected to the back leg 24 in a perpendicular relationship. The pivoting pin or hinge 23 permits the front leg 22 to fold under the device 10 permitting ease of storage and transport. When the pivot hinge 23 is fully open and the front foot 26 and back foot 28 are placed on a level surface, the front leg 22 and back leg 24 form an arc that is slightly offset having a high point 25. The base support assembly 20 includes a locking mechanism 27 which is the same or similar to those used on conventional ladders. The locking mechanism 27 holds the ground-engaging sub-frames 22, 24 in an open position by a flange 29 on the end of the back leg 24 nearest the pivot pin 23 abutting against the top of the front leg 22 when the base support assembly is in the open position, the flange 29 of the back leg 24 preventing the front leg 22 from pivoting past the open position in a first direction while allowing the base support assembly 20 to move into a folded position in a second direction as the exercise device 10 is moved into the folded position. Alternatively, the locking mechanism 27 comprises the pivot pin 23 joining the front and back legs 22, 24 which only pivots between the open and folded positions.

The seat assembly 30 includes a spring bracket 34, a resistance spring 32 (e.g., a spring coil) connected to the spring bracket 34, a support handle 36 also connected to the spring bracket 34, and a seat platform 38 connected to the resistance spring 32. The spring bracket 34 is designed to be fixedly connected to the high point 25 of the base support assembly 20. The connection between the spring bracket 34 and the high point 25 is such that there is little to no relative movement between the base support assembly 20 and the spring bracket 34. The spring bracket 34 connects to the base support assembly 20 such that the resistance spring 32 rises vertically from the spring bracket 34.

The seat platform 38 is connected to the resistance spring 32 at the end most distal from the spring bracket 34. The seat platform 38 and resistance spring 32 are connected in a perpendicular relationship such that the seat platform 38 is horizontal to the surface upon which the base support assembly 20 rests. The support handle 36 is connected to the spring bracket 34 and has support arms 37 which rise up on either side of the seat platform 38. The support arms 37 are fixed relative to the base support assembly 20 and extend upwardly therefrom. The support handle 36 and support arms 37 are configured such that a user sitting on the seat platform 38 may comfortably grasp the support arms 37 with his or her hands.

The leg support assembly 40 includes a support bar 42, a crossbar 44 and a footrest 46. One end of the support bar 42 is connected to the seat platform 38. The other end of the support bar 42 is connected to the crossbar 44. The crossbar 44 includes padded footrests 46. The leg support assembly 40 is configured in such a way that an individual sitting on the seat platform 38 may comfortably support his or her feet on the footrest 46. Alternatively, the leg support assembly 40 includes a length adjustment mechanism that allows the distance between the footrests 46 and the seat platform 38 to be adjusted in order to accommodate users with a wider variety of heights, including relative distance between feet and torso.

The back support assembly 50 includes a back support or pad 52, a hollow upright bar 54, an upright hinge connection 56, a resistance piston 60, a piston hinge connection 66, and an adjustable resistance ring 58. The upright bar 54 connects to the back leg 24 by means of the upright hinge connection 56. The upright hinge connection 56 is on the back leg 24 about mid way between the high point 25 and the back foot 28 and permits the upright bar 54 to pivotally rotate about this point on the back leg 24. The back pad 52 is connected to the upright bar 54 at the end most distal from the upright hinge connection 56. The resistance piston 60 provides resistance to pivotal movement of the back support assembly 50 relative to the base support assembly 20. The resistance piston 60 includes a static arm 62 and a sliding arm 64. The static arm 62 is pivotally connected to the back leg 24 by means of the piston hinge connection 66 at a point adjacent to the back foot 28. The static arm 62 is adjustably connected to the upright bar 54 by means of the adjustable resistance ring 58. The adjustable resistance ring 58 is designed to adjustably slide up or down the upright bar 54 so that a user may adjust the relative position or angle of the back pad 52 and upright bar 54 to the base support assembly 20. The spring 32 creates resistance and causes the seat platform 38 to move toward the starting position.

The back support assembly 50 includes a locking mechanism 51 for holding the back pad 52 in one of a plurality of positions along the length of the upright bar 54 by holding and/or releasing the back pad 52 to telescopically move relative to the upright bar 54. This allows the relative distance between the back pad 52 and an end of the upright bar 54 to be increased and/or decreased. The back pad 52 is connected to a hollow back pad bar 53 which telescopically extends into the hollow upright bar 54. The locking mechanism 51 includes a bent flexible member (not shown), including a cylindrical post or stub 55, located within the hollow back pad bar 53. The stub 55 extends through an aperture (not shown) of the back pad bar 53 and through one aperture 57 of a plurality of apertures 57 along the upright bar 54 which the aperture of the back pad bar 53 is aligned with. At any given time when the back pad 52 is locked in position, the stub 55 extends through only a particular one of the plurality of apertures 57 located at fixed points along the upright bar 54. A user can move the back pad 52 relative to the upright bar 54 by depressing the stub 55 extending through a particular one of the apertures 57 of the upright bar 54. Once the stub 55 is depressed so that the stub 55 no longer engages the aperture 57 of the upright bar 54, the back pad 52 (and the back pad bar 57 which telescopically extends into the hollow upright bar 54) is moved relative to the upright bar 54, the interior surface of the upright bar 54 maintains the stub 55 in a depressed position. However, the stub 55 becomes coaxial with another aperture 57 of the upright bar 54, the force of the flexible member pushes the stub 55 through the aperture 57 that the stub 55 is aligned with the aperture 57, locking the back pad 52 in a new position relative to the upright bar 54. The process of depressing the stub 55 to allow the back pad 52 to travel relative to the upright bar 54 may be repeated until the desired distance between the back pad 52 and the upright bar 54 is achieved.

Figure 8:
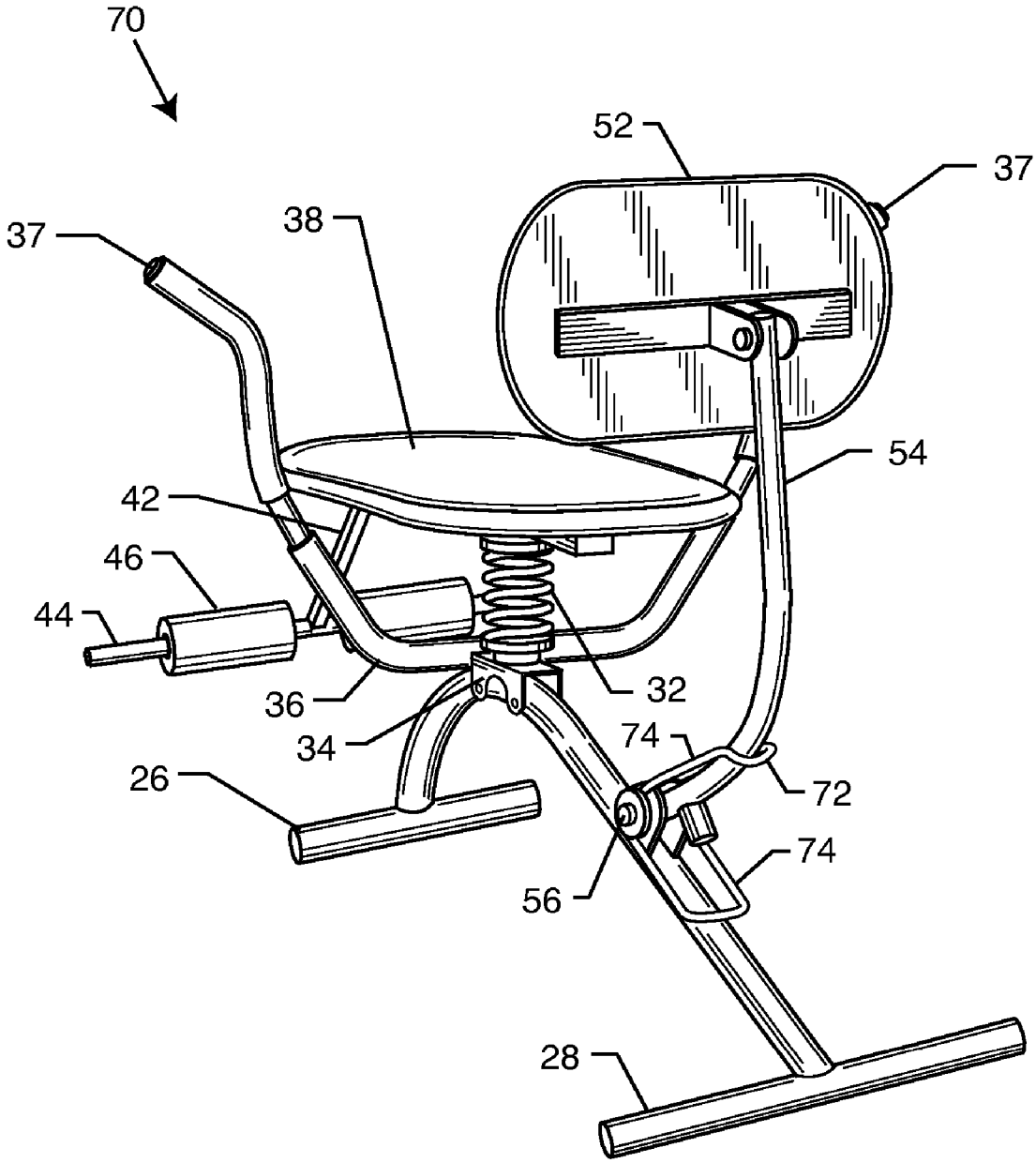
FIG. 8 is an elevated rear perspective view of another torso exercise device of the present invention.

In accordance with another embodiment, the torso exercise device 70 of FIG. 8 is similar to the torso exercise device 10 except that the torso exercise device 70 uses a torsion spring 72 instead of the resistance piston 60. The torsion spring 72 is positioned about the back leg 24, the upright bar 54 and the upright hinge connection 56. The torsion spring 72 provides resistance to pivotal movement of the back support assembly 50 relative to the base support assembly 20. One leg 74 of the torsion spring 72 engages the back leg 24 while the other leg 74 engages the upright bar 54. The torsion spring 72 creates resistance and causes the back support assembly 50 to move toward the starting position.

In operation, an individual user may sit on the seat platform 38 placing his or her feet on the footrest 46 and grasping the support arms 37. When a user rotates or swivels his or her hips while seated on the platform 38, the resistance spring 32 will permit the seat to move in the direction of rotation or swivel. The connection of the seat platform 38 to the base support assembly 20 by resistance spring 32 enables multi-directional resistive movement (e.g., pivotal, orbital, swiveling or rotational oscillating movement) of the seat platform 38 relative to the base support assembly 20. This oscillation by the seat platform 38 will cause an individual while grasping the support arms 37 to use the muscles in his or her torso to counter the movement of the seat platform 38 thereby creating resistance and exercising the torso muscles. In this way, a user can cause the seat platform 38 and resistance spring 32 to oscillate back and forth creating repetitions of the resistance and resulting in exercise of the torso muscles. Because of the configuration of the resistance spring 32, an individual can cause the seat platform 38 to oscillate in any radial direction around the horizontal plane. Thus, an individual can oscillate the seat platform 38 forwards and backwards to exercise the abdominal and low back muscles. In addition, an individual can cause the seat platform 38 to oscillate side to side thereby exercising the external oblique muscles. Furthermore, an individual using the device 10 can cause the seat platform 38 to oscillate in any direction between side to side and front to back thereby exercising combinations of the abdominal, low back and external oblique muscles.

Ancillary to the exercise of the torso muscles, a user will also exercise other muscle groups such as the arms, shoulders, hands, chest and upper back by virtue of holding onto the stationary support arms 37.

The above-described embodiments of the present invention are illustrative only and not limiting. It will thus be apparent to those skilled in the art that various changes and modifications may be made without departing from this invention in its broader aspects. Therefore, the appended claims encompass all such changes and modifications as falling within the true spirit and scope of this invention.

What is claimed is:

1. A torso exercise device, comprising:

a base support frame;

a seat assembly including a seat and a spring coil disposed between the base support frame and the seat for connecting the seat to the base support frame in a manner enabling multi-directional resistive movement of the seat relative to the base support frame comprising pivotal, orbital, swiveling or rotational oscillating movement; and a back support assembly pivotally connected to the base support frame, wherein the back support assembly includes a back support and a torsion spring for providing resistance to pivotal movement of the back support relative to the base support frame.

2. The device of claim 1, including a leg support assembly extending from the seat assembly.

3. The device of claim 1, wherein the leg support assembly includes a footrest.

4. The device of claim 1, wherein the base support frame comprises two ground-engaging sub-frames, wherein the ground-engaging sub-frames are joined by a hinge including a lock for holding the ground-engaging sub-frames in an open position.

5. The device of claim 1, including a pair of handles fixed relative to the base support frame and extending upwardly therefrom.

6. The device of claim 1, wherein the back support assembly includes a back support and a resistance piston for providing resistance to pivotal movement of the back support relative to the base support frame.

7. A torso exercise device, comprising:

a base support frame;

a seat assembly including a seat and a spring coil disposed between the base support frame and the seat for connecting the seat to the base support frame in a manner enabling multi-directional resistive movement of the seat relative to the base support frame, wherein the multi-directional resistive movement comprises pivotal, orbital, swiveling or rotational oscillating movement; and a back support assembly pivotally connected to the base support frame, wherein the back support assembly includes a back support and means for providing resistance to pivotal movement of the back support relative to the base support frame, the resistance providing means including a torsion spring.

8. The device of claim 7, wherein the resistance providing means includes a resistance piston.

9. The device of claim 7, including a leg support assembly extending from the seat assembly, including a footrest.

10. The device of claim 7, including a pair of handles fixed relative to the base support frame and extending upwardly therefrom; and wherein the base support frame comprises two ground-engaging sub-frames, wherein the ground-engaging sub-frames are joined by a hinge including a lock for holding the ground-engaging sub-frames in an open position.

11. A torso exercise device, comprising:

a base support frame comprising two ground-engaging sub-frames, wherein the ground-engaging sub-frames are joined by a hinge including a lock for holding the ground-engaging sub-frames in an open position;

a seat assembly including a seat and a spring coil disposed between the base support frame and the seat for connecting the seat to the base support frame in a manner enabling multi-directional resistive movement of the seat relative to the base support frame comprising pivotal, orbital, swiveling or rotational oscillating movement; and a back support assembly pivotally connected to the base support frame.

12. A torso exercise device, comprising:

a base support frame;

a pair of handles fixed relative to the base support frame and extending upwardly therefrom;

a seat assembly including a seat and a spring coil disposed between the base support frame and the seat for connecting the seat to the base support frame in a manner enabling multi-directional resistive movement of the seat relative to the base support frame comprising pivotal, orbital, swiveling or rotational oscillating movement; and a back support assembly pivotally connected to the base support frame.

13. A torso exercise device, comprising:

a base support frame;

a seat assembly including a seat and a spring coil disposed between the base support frame and the seat for connecting the seat to the base support frame in a manner enabling multi-directional resistive movement of the seat relative to the base support frame comprising pivotal, orbital, swiveling or rotational oscillating movement; and back support assembly pivotally connected to the base support frame, wherein the back support assembly includes a back support and a resistance piston for providing resistance to pivotal movement of the back support relative to the base support frame.

14. The device of claim 13, including a leg support assembly extending from the seat assembly.

15. The device of claim 13, wherein the leg support assembly includes a footrest.

16. The device of claim 13, wherein the base support frame comprises two ground-engaging sub-frames, wherein the ground-engaging sub-frames are joined by a hinge including a lock for holding the ground-engaging sub-frames in an open position.

17. A torso exercise device, comprising:

a base support frame;

a seat assembly including a seat and a spring coil disposed between the base support frame and the seat for connecting the seat to the base support frame in a manner enabling multi-directional resistive movement of the seat relative to the base support frame, wherein the multi-directional resistive movement comprises pivotal, orbital, swiveling or rotational oscillating movement; and a back support assembly pivotally connected to the base support frame, wherein the back support assembly includes a back support and means for providing resistance to pivotal movement of the back support relative to the base support frame, wherein the resistance providing means includes a resistance piston.

18. The device of claim 17, including a leg support assembly extending from the seat assembly, including a footrest.

19. The device of claim 17, including a pair of handles fixed relative to the base support frame and extending upwardly therefrom; and wherein the base support frame comprises two ground-engaging sub-frames, wherein the ground-engaging sub-frames are joined by a hinge including a lock for holding the ground-engaging sub-frames in an open position.

20. A torso exercise device, comprising:

a base support frame;

a seat assembly including a seat and a spring coil disposed between the base support frame and the seat for connecting the seat to the base support frame in a manner enabling multi-directional resistive movement of the seat relative to the base support frame;

a back support assembly pivotally connected to the base support frame, wherein the back support assembly includes a back support and means for providing resistance to pivotal movement of the back support relative to the base support frame; and a pair of handles fixed relative to the base support frame and extending upwardly therefrom;

wherein the base support frame comprises two ground-engaging sub-frames, and wherein the ground-engaging sub-frames are joined by a hinge including a lock for holding the ground-engaging sub-frames in an open position.

* * * * *